US005697647A

United States Patent [19]

Ruescas

[11] Patent Number: 5,697,647

[45] Date of Patent: Dec. 16, 1997

[54] HAIRSTYLIST APPOINTMENT CALENDAR

[76] Inventor: Maria I. Ruescas, 733 Marin Ave., Lyndhurst, N.J. 07071

[21] Appl. No.: 535,754

[22] Filed: Sep. 28, 1995

[51] Int. Cl.[6] ..... B42D 5/04

[52] U.S. Cl. ..... 283/3; 283/2; 40/107

[58] Field of Search ..... 283/2, 38, 42, 283/3, 4, 36–41; 40/107, 119, 109; 281/15.1

[56] References Cited

U.S. PATENT DOCUMENTS

| | | | |
|---|---|---|---|
| 1,018,641 | 2/1912 | Strayer | 283/2 |
| 1,680,164 | 8/1928 | Montrose | 40/517 |
| 3,275,343 | 9/1966 | Holm | 283/4 X |
| 3,633,298 | 1/1972 | Grier, Jr. | 40/116 |
| 4,043,063 | 8/1977 | Ambasz | 40/119 |
| 4,489,958 | 12/1984 | Martin | 283/3 |
| 4,669,754 | 6/1987 | Lalonde | 283/67 |
| 4,794,711 | 1/1989 | Christensen | 40/122 |
| 4,813,711 | 3/1989 | Bohlman | 283/900 |
| 4,932,682 | 6/1990 | Miller | 283/900 |
| 5,374,083 | 12/1994 | Slocomb | 283/2 |

FOREIGN PATENT DOCUMENTS

| | | | |
|---|---|---|---|
| 446122 | 9/1991 | European Pat. Off. | 283/4 |
| 1501853 | 10/1967 | France | 283/4 |
| 1970770 | 8/1970 | German Dem. Rep. | 283/3 |

*Primary Examiner*—Willmon Fridie, Jr.
*Attorney, Agent, or Firm*—Brady, O'Boyle & Gates

[57] ABSTRACT

An appointment calendar for a hairstylist wherein a book type calendar is provided having index tabs for the twelve (12) months of the year, and double pages for each day of a respective month. Each day page is divided into a plurality of rows and columns defining rectangular areas for insertion of a customer's name, home and work telephone numbers; and abbreviation indicia indicating the particular service performed on the customer. The margin of each page contains a column with additional indicia, defining the abbreviation indicia in the rectangular areas. The margin of one page also includes indicia indicating the time of day in half-hour increments adjacent respective rows of rectangular areas for the first part of a particular day and the margin of the other page similarly includes indicia indicating the time of day in half-hour increments for the second part of the particular day. The pages of the book are connected to a spiral-type binder and are perforated along a line adjacent the binder for tearing the page from the book, if desired. The calendar can be divided into two books each having index tabs for six consecutive months of the year with one book representing January through June and the other book representing July through December and double pages for each day of a respective month.

6 Claims, 5 Drawing Sheets

HAIRSTYLIST APPOINTMENT CALENDAR

BACKGROUND OF THE INVENTION

Various appointment books have been proposed for recording the date, the name of the customer or client, and the service provided. While these appointment books have been generally satisfactory for their intended purpose, they are usually "hand written" and oftentimes difficult to read and understand. To overcome the disadvantages experienced with informal appointment books, the appointment calendar of the present invention has been devised to give structure to the taking of appointments and is constructed and arranged to be easily understood, whether the appointment is entered by the person performing the service, or by someone else, such as a receptionist.

SUMMARY OF THE INVENTION

The appointment calendar of the present invention is for use by a hairstylist and comprises, essentially, a book-type calendar having index tabs for the twelve (12) months of the year, and double pages for each day of a respective month. Each day page is divided into a plurality of rows and columns defining rectangular areas for insertion of a customer's name, home and work telephone numbers, and abbreviation indicia indicating the particular service performed on the customer. The margin of each page contains a column with additional indicia, defining the abbreviation indicia in the rectangular areas. The margin of one page also includes indicia indicating the time of day in half-hour (½) increments adjacent respective rows of rectangular areas for the first part of a particular day, and the margin of the other page similarly includes indicia indicating the time of day in half-hour (½) increments for the second part of the particular day.

The pages of the book are connected to a spiral-type binder and are perforated along a line adjacent the binder for tearing the page from the book, if desired.

DESCRIPTION OF THE PREFERRED EMBODIMENTS

Figure 1:
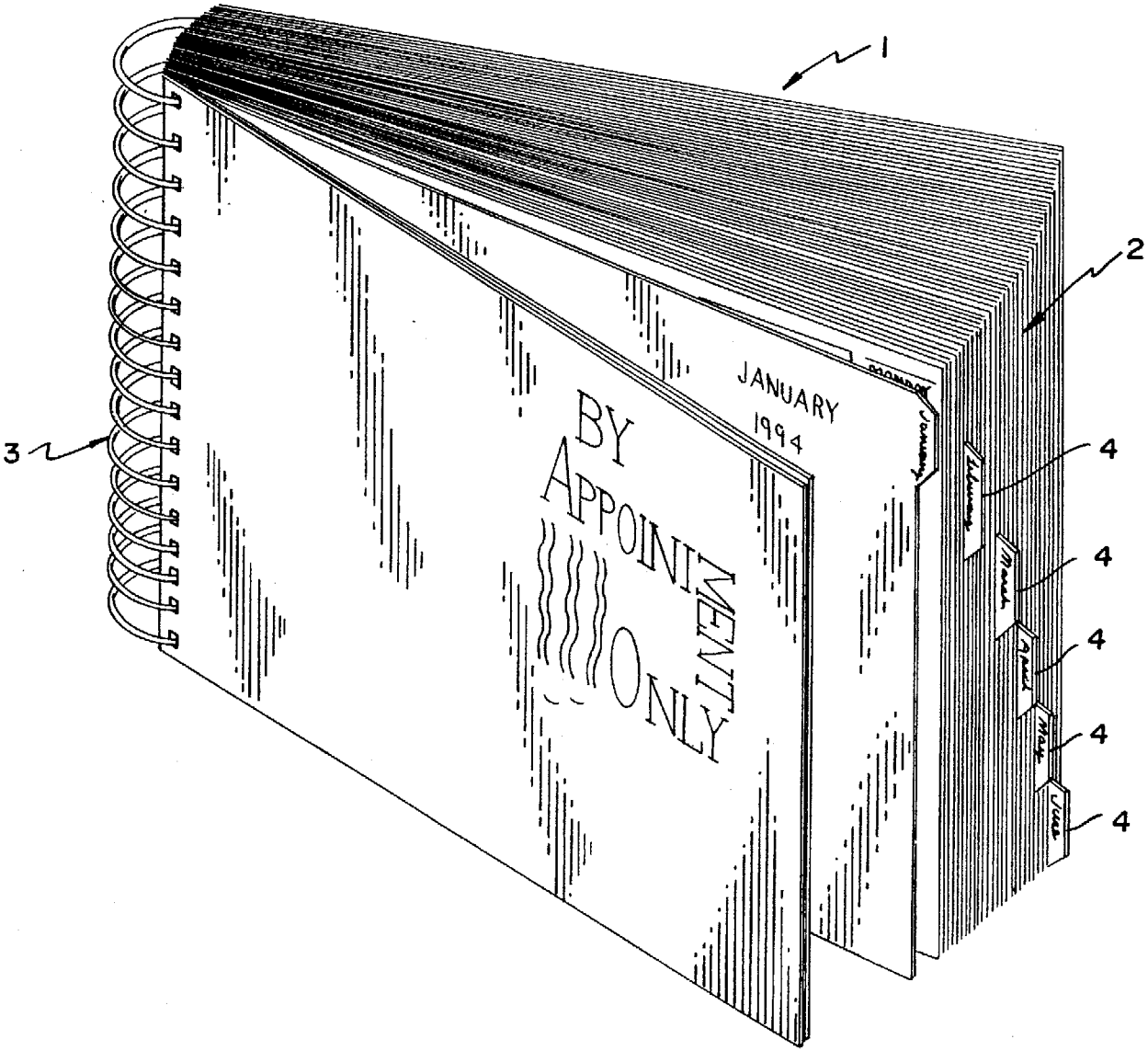
FIG. 1 is a perspective view of the appointment calendar of the present invention.
Figure 2:
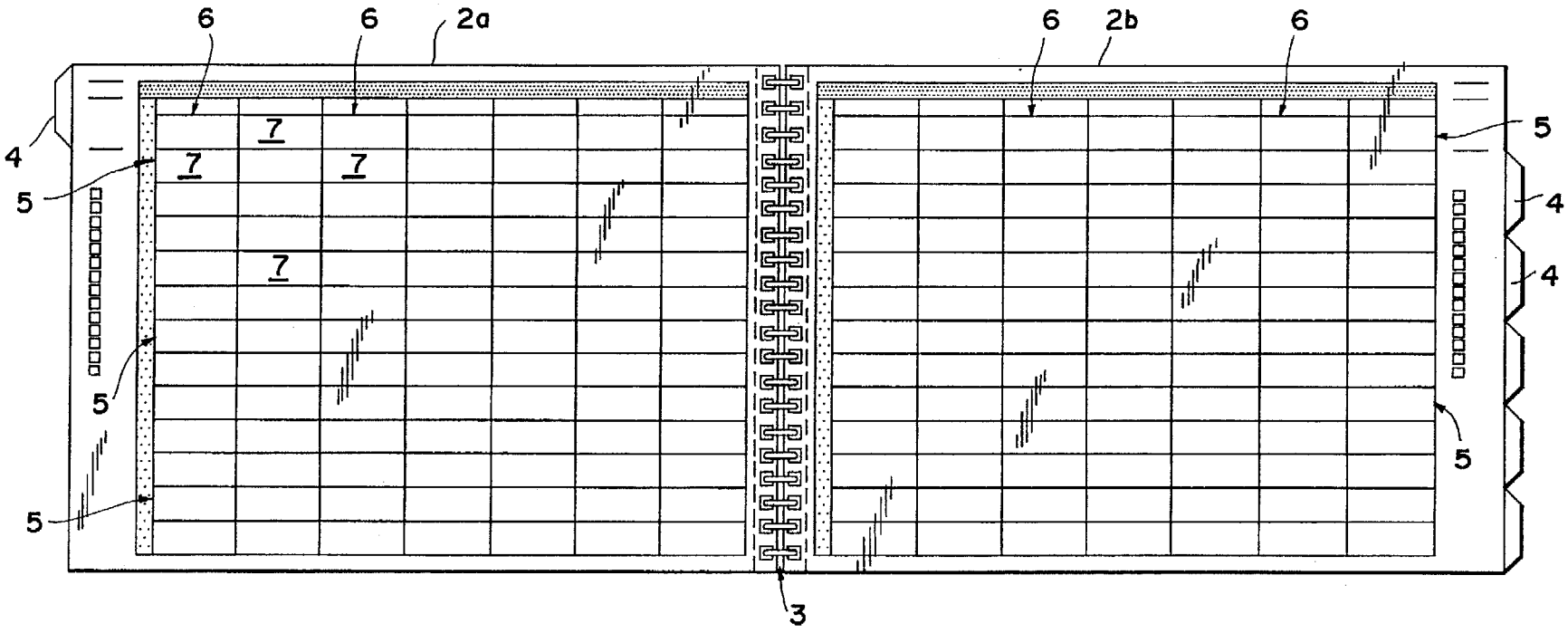
FIG. 2 is a plan view of the appointment calendar, shown in FIG. 1, in the open position.

Referring to the drawings and, more particularly, to FIGS. 1 and 2, the appointment calendar of the present invention is a book type calendar 1 having pages 2 bound at the spine by a spiral-type binder 3. Certain pages of the book are provided with index tabs 4 for dividing the book into the twelve (12) months of the year, and double pages *2a, 2b* are provided for each day of a respective month. Each day page *2a, 2b* is divided into a plurality rows 5 and columns 6 defining rectangular areas 7 containing client or customer information. *2b* are provided for each day of a respective month. Each day page *2a, 2b* is divided into a plurality rows 5 and columns 6 defining rectangular areas 7 containing the operator's name and client or customer information.

Figure 3:
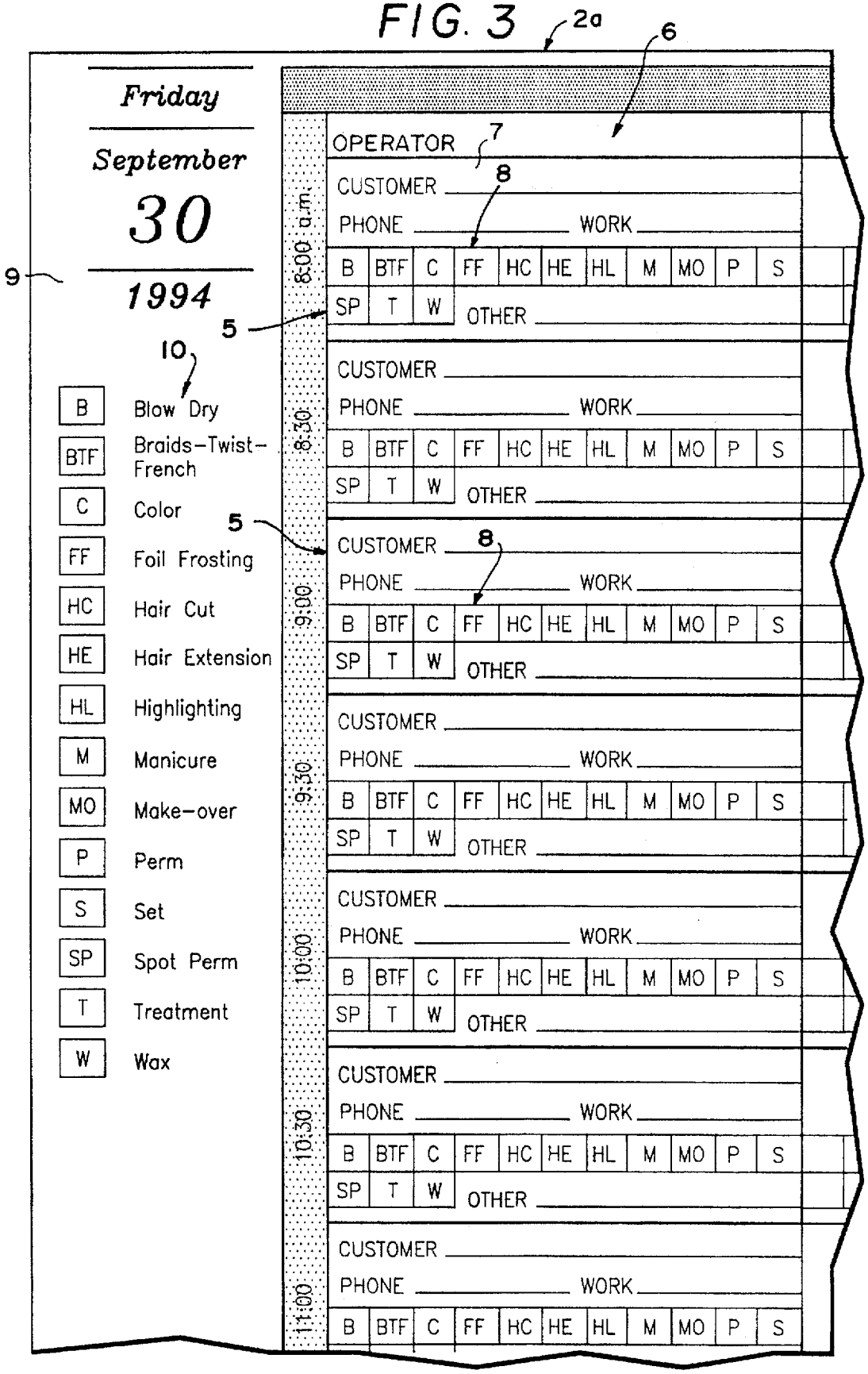
FIG. 3 is an enlarged, fragmentary, plan view showing the details of the left side of the calendar shown in FIG. 2.

The details of the construction of the left side of page *2a* are illustrated in FIG. 3, wherein it will be seen that the information contained in the rectangular areas consists of the operator's name, the customer's name, home and work telephone numbers, and abbreviation indicia 8 indicating the particular service performed on the customer. The left margin 9 of page *2a* contains indicia 10 defining the abbreviation indicia 8. In the instant case, the appointment calendar has been devised for hairstylists; thus, indicia 10 defines the abbreviation "B" as "Blow Dry", "C" as "Color", etc.

The margin 9 also contains indicia indicating the time of day in half-hour (½) increments adjacent the rows 5 of rectangular areas 7. The time of day indicated on page *2a* represents the first part of the day; that is, the time of the day before lunch.

Figure 4:
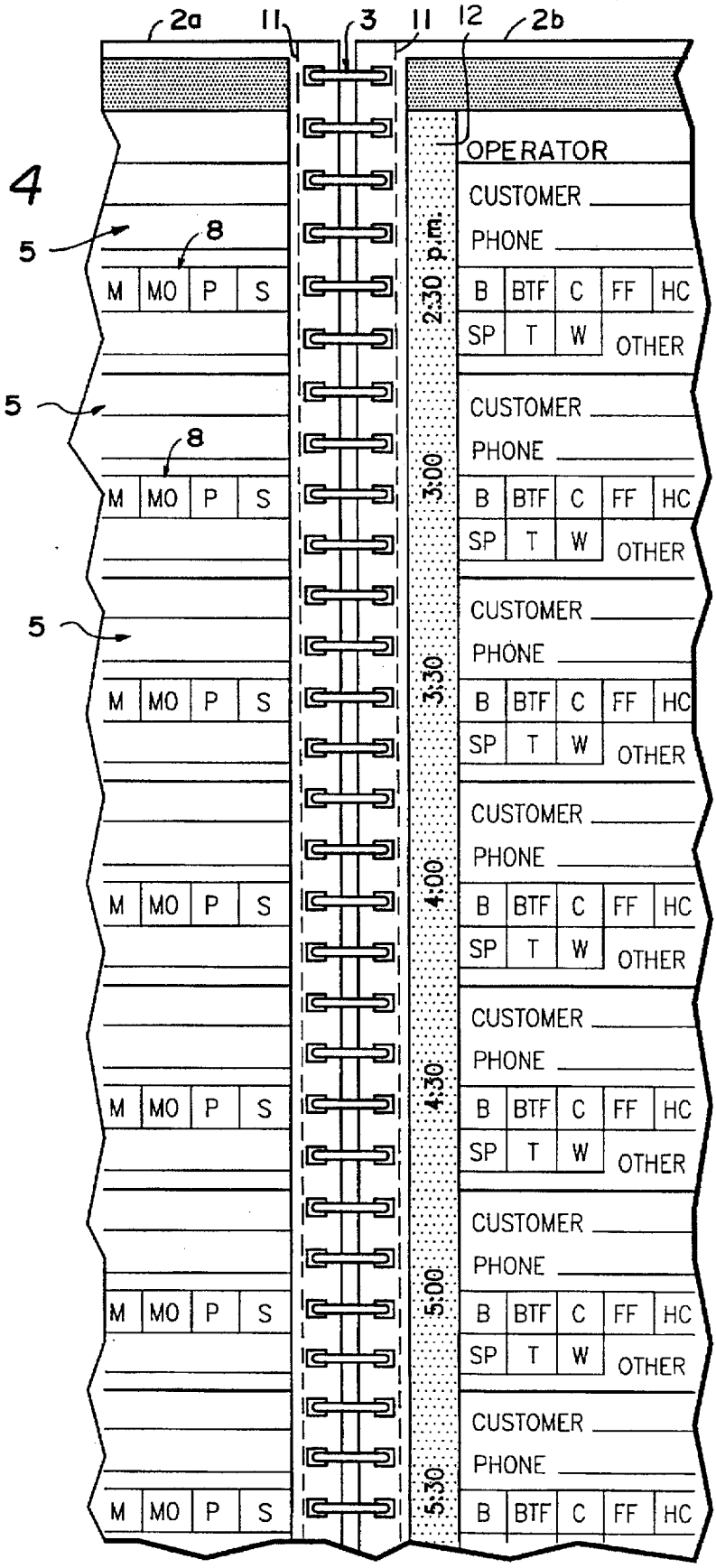
FIG. 4 is an enlarged, fragmentary, plan view showing the details of the middle of the calendar shown in FIG. 2.

FIG. 4 illustrates the details of the construction of the middle of the calendar showing the opposing edges of pages *2a* and *2b* being interconnected by the spiral binder 3. Also, each of the pages *2a* and *2b* is provided with a line 11 of perforation adjacent the binder 3 so that the pages can be removed from the book as desired. It will also be seen in FIG. 4 that the left margin 12 of page *2b* contains time of day indicia representing the second part of the day; that is, the time of day after lunch.

Figure 5:
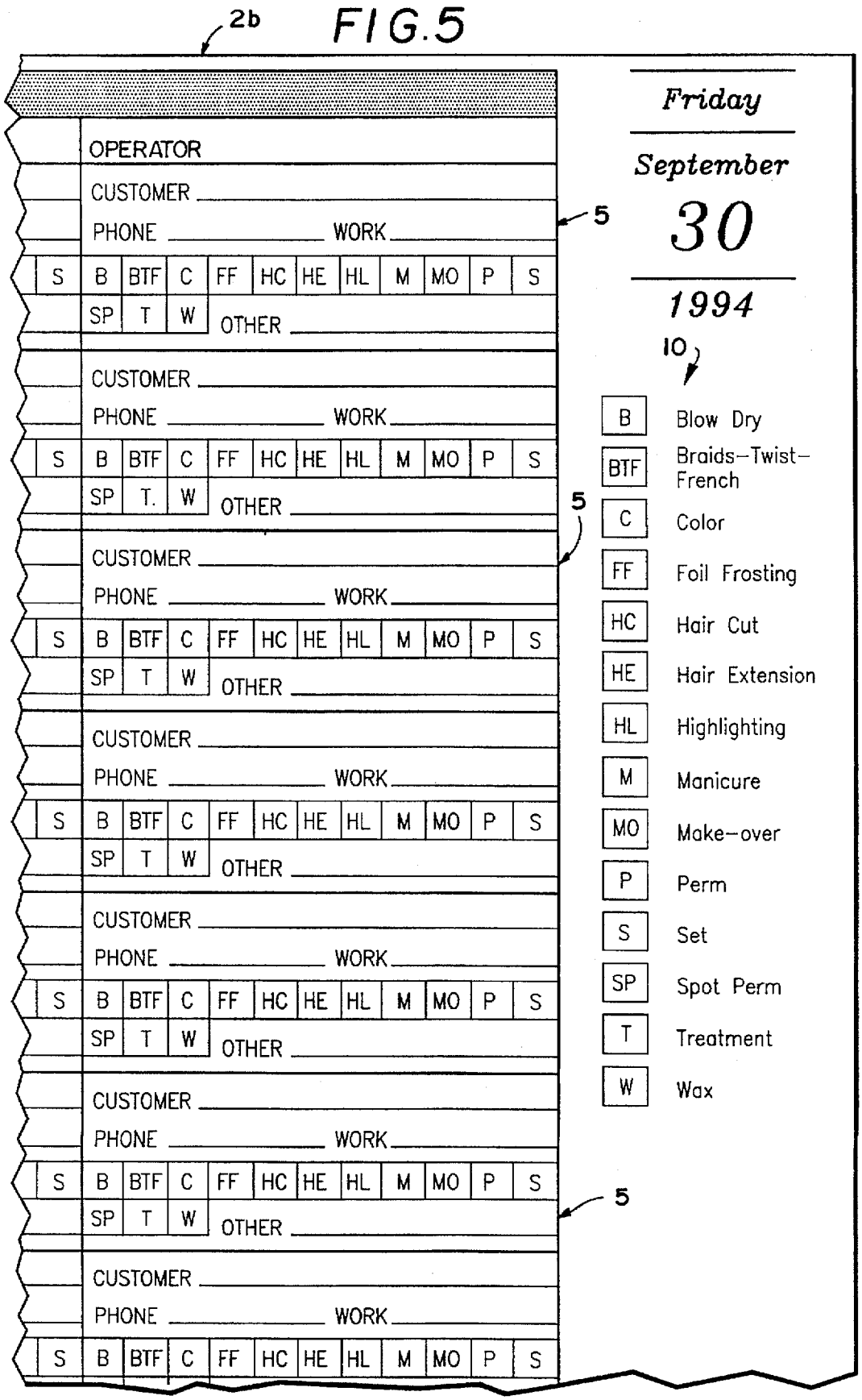
FIG. 5 is an enlarged, fragmentary, plan view showing the details of the right side of the calendar shown in FIG. 2.

FIG. 5 illustrates the details of the construction of the right side of page *2b* which are identical to the left side of page *2a;* that is, the indicia on the right side of *2b* is identical to the indicia on the left side of page *2a*.

In using the calendar, the receptionist can make an appointment for a customer for a particular day and at a certain time by recording the customer's name, and home and work telephone numbers in a particular rectangular area 7 on either page *2a* or *2b*. The receptionist will also selectively mark the abbreviation indicia 8 indicating the particular service to be provided by the hairstylist. Each day the hairstylist has to merely look at pages *2a* and *2b* to determine at what time a particular service is to be performed on a customer. It also aids at a glance the estimated time needed to complete a particular service, therefore, avoiding over and/or under booking clients and also serves as a sales reminder of the services available.

By keeping the pages of the calendar in book form, a record of the service is kept so that if the customer calls again at a later date for an appointment, the calendar can be reviewed to determine what service was provided, whereby a recommendation can be made to the customer with regard to performing the same service or an additional service.

While the calendar of the present invention has been described for use by hairstylists, it will be appreciated by those skilled in the art, that the calendar can be constructed and arranged for other personal service providers, such as doctors, dentists, auto mechanics, and the like by changing the indicia 8 and 10 to correspond to the various services performed by the provider.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. An appointment calendar for a service provider comprising at least one page having day, month, and year indicia thereon, said page being divided into a plurality of rows and columns defining rectangular areas, each rectangular area containing portions for recording the name and telephone numbers of a person for whom the service is to be provided, first indicia contained in each rectangular area defining an abbreviation of a plurality of selected services to be provided, said page having a margin, said margin being integral and continuous with said page, second indicia contained in said margin including said first indicia and describing said selected services indicated by the first indicia, and incremental time of the day indicia contained in said margin adjacent each row, whereby the information concerning the person being provided the service and the particular service provided can be recorded on the page, a plurality of said pages being assembled in book form having a spine, a binder connecting the pages together to form the spine of the book, certain pages having index tabs secured to edges thereof indicating the twelve months of the year, double pages being provided for each day of a respective month, one page being on one side of the binder and the other page being on the other side of the binder when the book is open.

2. An appointment calendar according to claim 1, wherein the incremental time of the day indicia on said one page defines the morning portion of the day, and the incremental time of the day indicia on said other page defines the afternoon portion of the day.

3. An appointment calendar according to claim 1, wherein a line of perforations is provided in each page adjacent the binder, whereby a page can be removed from the book.

4. An appointment calendar according to claim 1 wherein the service provider is a hairstylist, the first indicia being abbreviations for various cosmetic services performed on a person, and said second indicia defining the specific services abbreviated in said first indicia.

5. An appointment calendar according to claim 4, wherein the abbreviations consist of "B", "BTF", "C", "FF", "HC", "HE", "HL", "M", "MO", "P", "S", "SP", "T", and "W"; and the second indicia consists of "Blow Dry", "Braids-Twist-French", "Color", "Foil Frosting", "Hair Cut", "Hair Extension", "Highlighting", "Manicure", "Make-Over", "Perm", "Set", "Spot Perm", "Treatment", and "Wax", respectively.

6. An appointment calendar for a service provider comprising at least one page having day, month, and year indicia thereon, said page being divided into a plurality of rows and columns defining rectangular areas, each rectangular area containing portions for recording the name and telephone numbers of a person for whom the service is to be provided, first indicia contained in each rectangular area defining an abbreviation of a plurality of selected services to be provided, said page having a margin, said margin being integrated and continuous with said pages, second indicia contained in said margin including said first indicia and describing said selected services indicated by the first indicia, and incremental time of the day indicia contained in said margin adjacent each row, whereby the information concerning the person being provided the service and the particular service provided can be recorded on the page, a plurality of pages being assembled in book form, one book having certain pages having index tabs secured to edges thereof indicating the first six months of the year, another book having certain pages having index tabs secured to edges thereof indicating the second six months of the year, and double pages being provided for each day of a respective month.

* * * * *